US008170254B2

(12) United States Patent
Tracy

(10) Patent No.: US 8,170,254 B2
(45) Date of Patent: May 1, 2012

(54) LOW PROFILE LOUDSPEAKER

(76) Inventor: Dennis A. Tracy, Culver City, CA (US)

( * ) Notice: Subject to any disclaimer, the term of this patent is extended or adjusted under 35 U.S.C. 154(b) by 909 days.

(21) Appl. No.: 12/216,317

(22) Filed: Jul. 2, 2008

(65) Prior Publication Data

US 2009/0010469 A1 Jan. 8, 2009

Related U.S. Application Data

(60) Provisional application No. 60/929,519, filed on Jul. 2, 2007.

(51) Int. Cl.
*H04R 1/20* (2006.01)

(52) U.S. Cl. ..... 381/338; 84/337; 84/345

(58) Field of Classification Search ..... None
See application file for complete search history.

(56) References Cited

U.S. PATENT DOCUMENTS

| | | | | |
|---|---|---|---|---|
| 3,573,399 | A * | 4/1971 | Schroeder et al. | 381/92 |
| 4,675,906 | A * | 6/1987 | Sessler et al. | 381/92 |
| 5,146,508 | A | 9/1992 | Bader et al. | |
| 6,460,651 | B1 * | 10/2002 | Sahyoun | 181/157 |
| 6,912,290 | B1 * | 6/2005 | Thorsell et al. | 381/338 |
| 7,088,838 | B2 * | 8/2006 | Rye et al. | 381/336 |
| 7,224,813 | B2 * | 5/2007 | Hooley et al. | 381/190 |
| 7,366,310 | B2 * | 4/2008 | Stinson et al. | 381/92 |
| 7,837,006 | B1 * | 11/2010 | Graber | 181/191 |
| 2004/0202343 | A1 * | 10/2004 | Rye et al. | 381/353 |
| 2004/0218778 | A1 * | 11/2004 | Weisman | 381/396 |
| 2005/0196012 | A1 * | 9/2005 | Babb et al. | 381/412 |
| 2007/0116304 | A1 * | 5/2007 | Hall et al. | 381/152 |
| 2008/0025549 | A1 * | 1/2008 | Avera | 381/397 |
| 2008/0225510 | A1 * | 9/2008 | Rocha | 362/86 |
| 2009/0010469 | A1 * | 1/2009 | Tracy | 381/338 |
| 2009/0123005 | A1 * | 5/2009 | Holt et al. | 381/117 |
| 2010/0040254 | A1 * | 2/2010 | Wright | 381/395 |
| 2010/0215196 | A1 * | 8/2010 | Schulze et al. | 381/177 |

* cited by examiner

*Primary Examiner* — Marlon Fletcher
(74) *Attorney, Agent, or Firm* — Welsh Flaxman & Gitler LLC

(57) ABSTRACT

A loudspeaker includes a toroidal shaped housing and at least one driver positioned within the housing. The driver is mounted within an arcuate enclosure such that a forward portion of the driver transmits sound beyond the enclosure and the rearward portion of the driver is substantially confined within the enclosure.

12 Claims, 6 Drawing Sheets

LOW PROFILE LOUDSPEAKER

CROSS REFERENCE TO RELATED APPLICATION

This application claims the benefit of U.S. Provisional Patent Application Ser. No. 60/929,519, entitled "LOW PROFILE LOUDSPEAKER", filed Jul. 2, 2007.

BACKGROUND OF THE INVENTION

1. Field of the Invention

The invention relates a loudspeaker. More particularly, the invention relates to a low profile, low frequency loudspeaker.

2. Description of the Related Art

The growth of the global community has made it desirable or even necessary for people from across the country, indeed, around the world, to interact for both professional and personal reasons. For a great many, this requires that they spend considerable time traveling, often over great distances. The vast majority will travel in aircraft.

Whether these people are traveling by private or commercial transport, they desire high quality entertainment during the many hours they must spend within the confines of an aircraft. However, while high quality entertainment, for example, digital video with CD quality sound, is readily available for theater and home use, the weight and size restrictions placed upon components for use in aircraft make it very difficult to incorporate high-fidelity systems within an aircraft.

In the aircraft industry, great priority is placed upon component weight and size reduction. In addition, spacing and positioning of the loudspeaker assemblies is critical to optimizing their operation in the confines of an aircraft. The size, weight and shape of conventional terrestrial loudspeaker designs adversely affect range and payload, as well as raising significant installation issues. These concerns are especially notable when one attempts to make changes within smaller private jets. For example, a relatively minor increase in the weight carried by an aircraft results in a substantial increase in its fuel consumption. In addition, the limited "real estate" available within an aircraft dictates that the use of that space be carefully considered by those responsible for ensuring the care and comfort of the passengers and crew.

Lightweight and compact audio loudspeakers are currently available. These loudspeakers, however, substantially compromise sound quality for reductions in size and weight. An individual wishing to add an audio system to an aircraft must make a choice between high-fidelity loudspeakers not suited to the size and weight requirements of the aircraft or lower quality loudspeakers comprised of more appropriate size and weight characteristics.

A need, therefore, exists for a loudspeaker assembly capable of reproducing high-fidelity sound, while simultaneously accommodating the size, weight and structural requirements of an aircraft. The present invention provides such a loudspeaker assembly.

SUMMARY OF THE INVENTION

It is, therefore, an object of the present invention to provide a loudspeaker including a toroidal shaped housing and at least one driver positioned within the housing. The driver is mounted within an arcuate enclosure such that a forward portion of the driver transmits sound beyond the enclosure and the rearward portion of the driver is substantially confined within the enclosure.

It is also an object of the present invention to provide a loudspeaker wherein the housing includes an upper housing member and a lower housing member, and the upper housing member is a split toroidal shape defining an upper surface of the housing and the lower housing member is substantially disk shaped defining a lower surface of the housing.

It is another object of the present invention to provide a loudspeaker wherein an annular opening is positioned between the upper surface and lower surfaces.

It is a further object of the present invention to provide a loudspeaker wherein the annular opening is defined by an inner edge of the upper housing member and a central flat portion of the lower housing member.

It is also an object of the present invention to provide a loudspeaker wherein the annular opening is formed along an inner wall of the housing positioned between the upper surface and the lower surface.

It is another object of the present invention to provide a loudspeaker wherein the inner wall of the housing defines a central opening that passes completely through the loudspeaker.

It is a further object of the present invention to provide a loudspeaker wherein the inner wall substantially defines a Venturi from which sound is emitted.

It is also an object of the present invention to provide a loudspeaker wherein the housing is constructed of liquid metal material.

It is another object of the present invention to provide a loudspeaker including a plurality of drivers positioned within the housing, each of the drivers being housed in an arcuate enclosure are positioned within the housing.

It is a further object of the present invention to provide a loudspeaker wherein the arcuate enclosures are positioned about the circumference of the housing to define a first ring.

It is also an object of the present invention to provide a loudspeaker wherein the arcuate enclosures are positioned about the circumference of the housing to define the first ring and a second ring.

It is another object of the present invention to provide a loudspeaker wherein first, second, third and fourth arcuate enclosures are positioned within the housing in a manner defining the first ring and fifth, sixth, seventh and eighth arcuate enclosures are positioned within the housing in a manner defining the second ring.

It is a further object of the present invention to provide a loudspeaker wherein each of the arcuate enclosures is constructed of liquid metal.

It is also an object of the present invention to provide a loudspeaker wherein lengths of the respective arcuate enclosures are varied.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
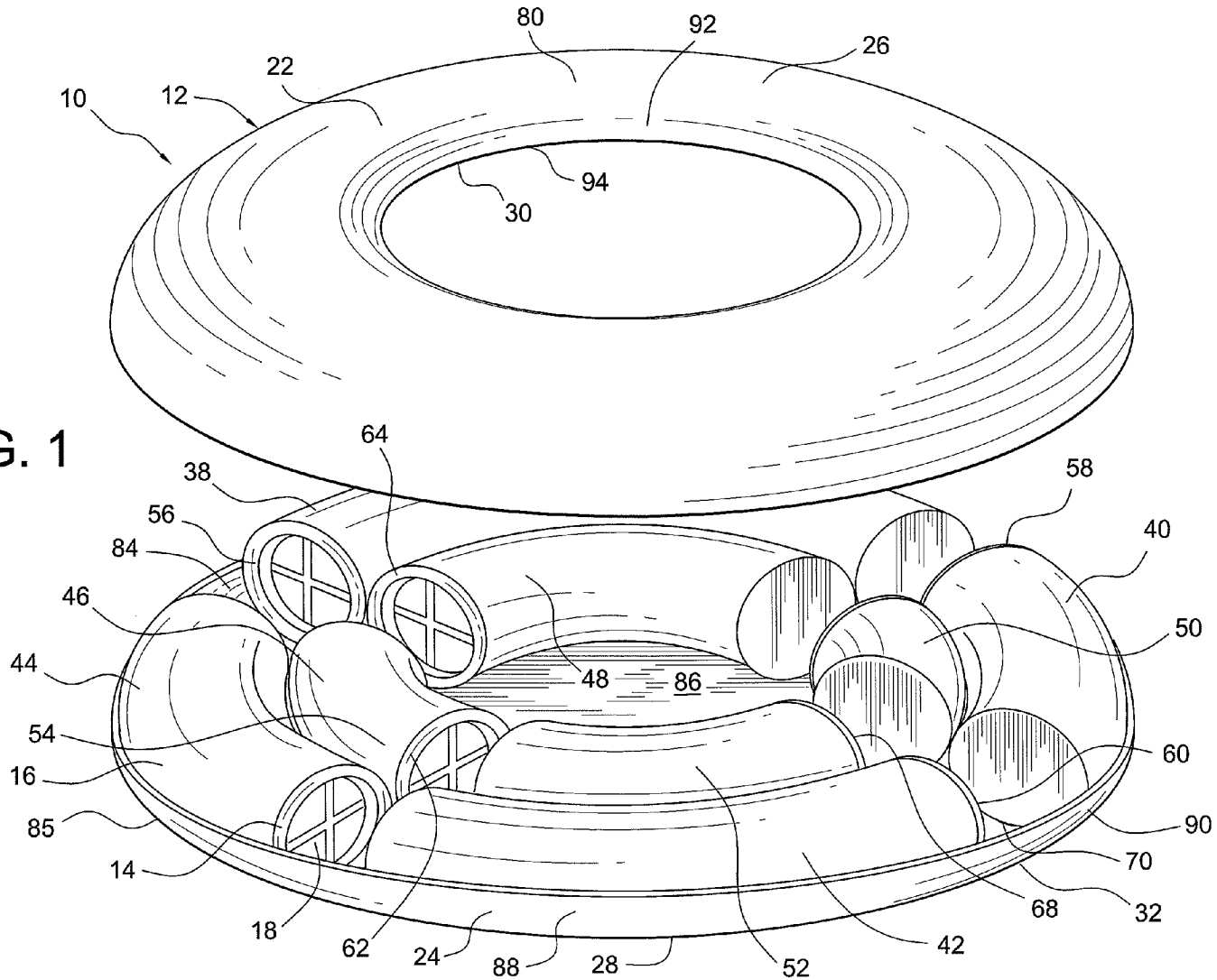
FIG. 1 is an exploded perspective view of the loudspeaker in accordance with the present invention.
Figure 2:
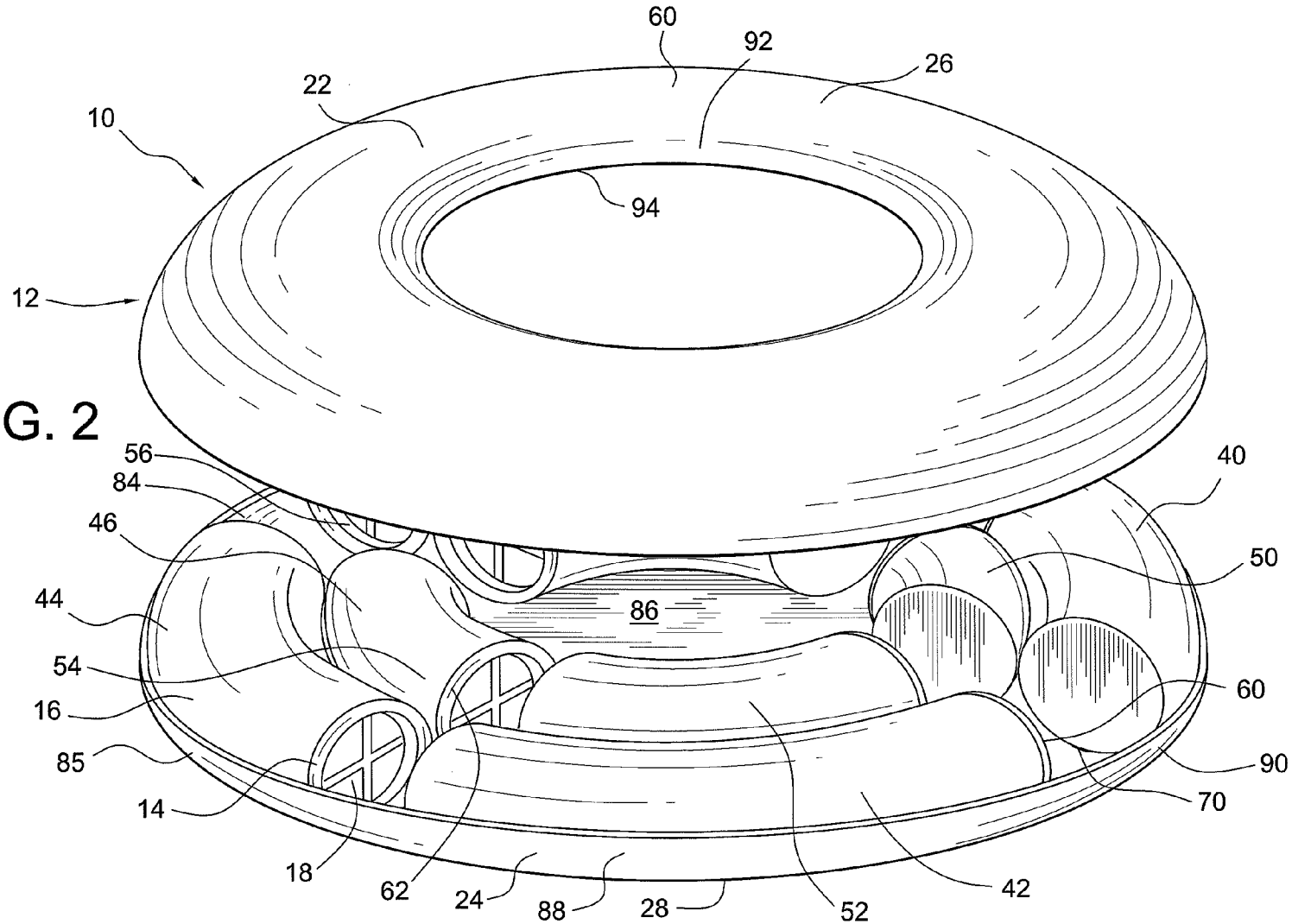
FIG. 2 is a further exploded perspective view of the loudspeaker shown with reference to FIG. 1.
Figure 4:
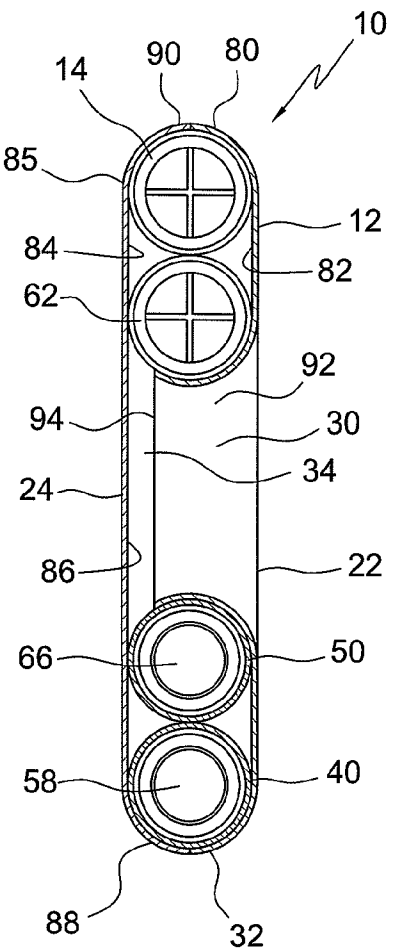
FIG. 4 is a cross sectional view along the line 4-4 in FIG. 3.
Figure 3:
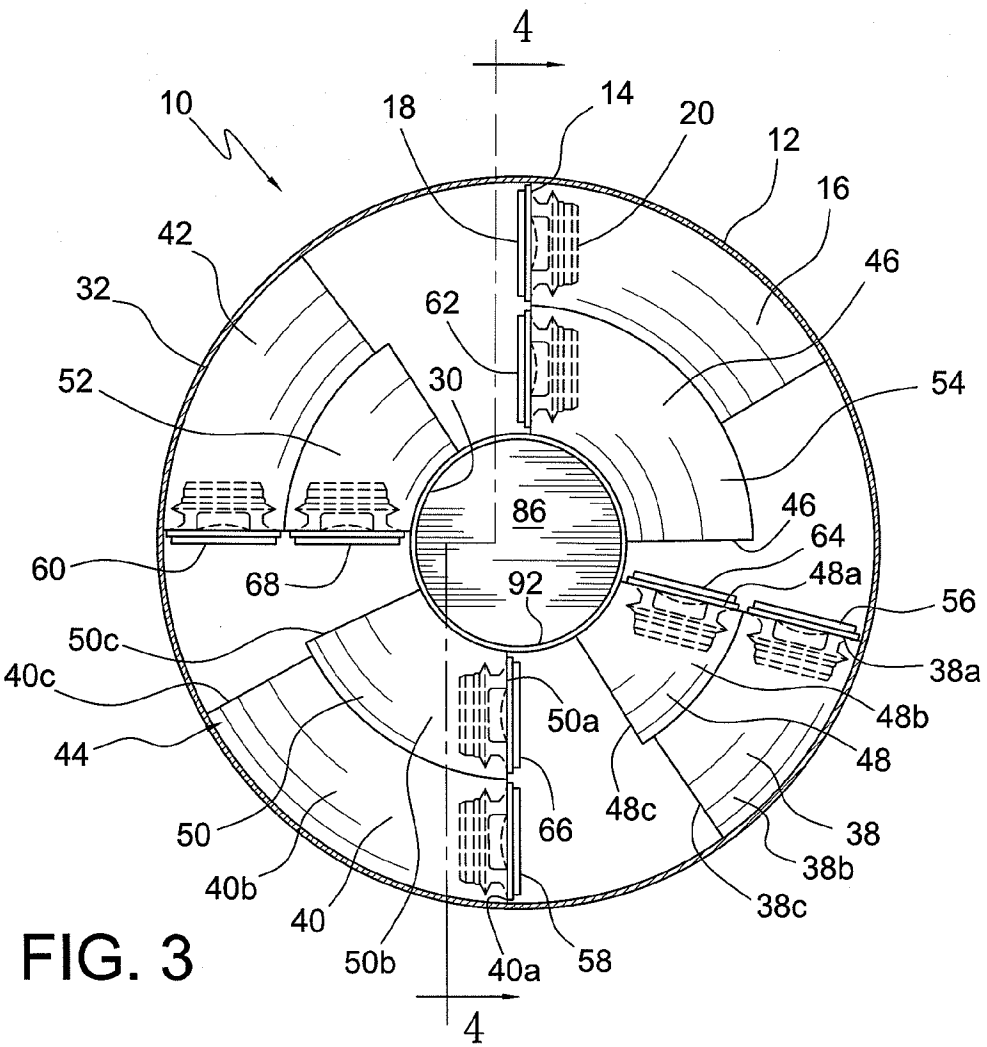
FIG. 3 is a top schematic view of the loudspeaker shown with reference to FIG. 1.
Figure 5:
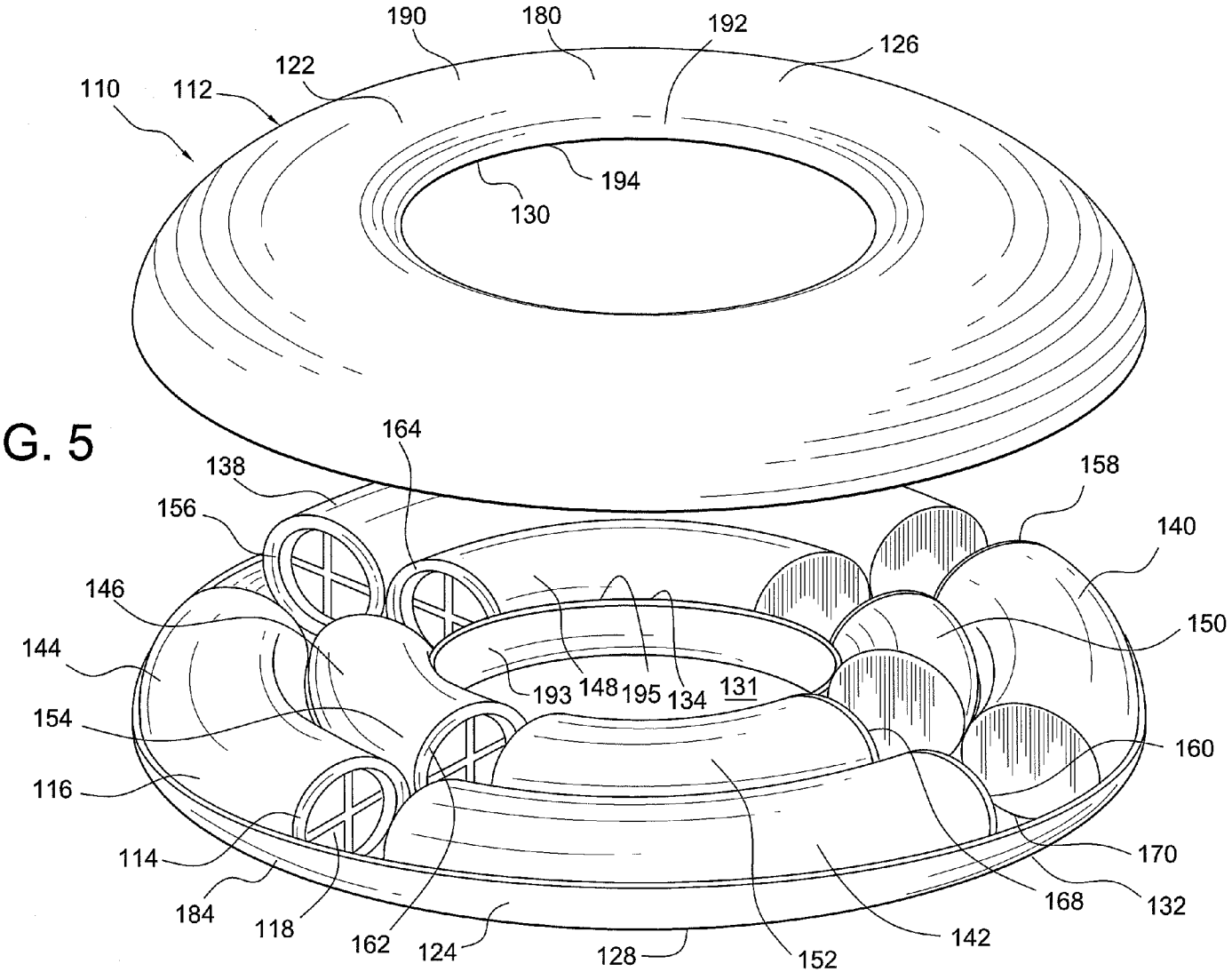
FIG. 5 is an exploded perspective view of the loudspeaker in accordance with an alternate embodiment.
Figure 6:
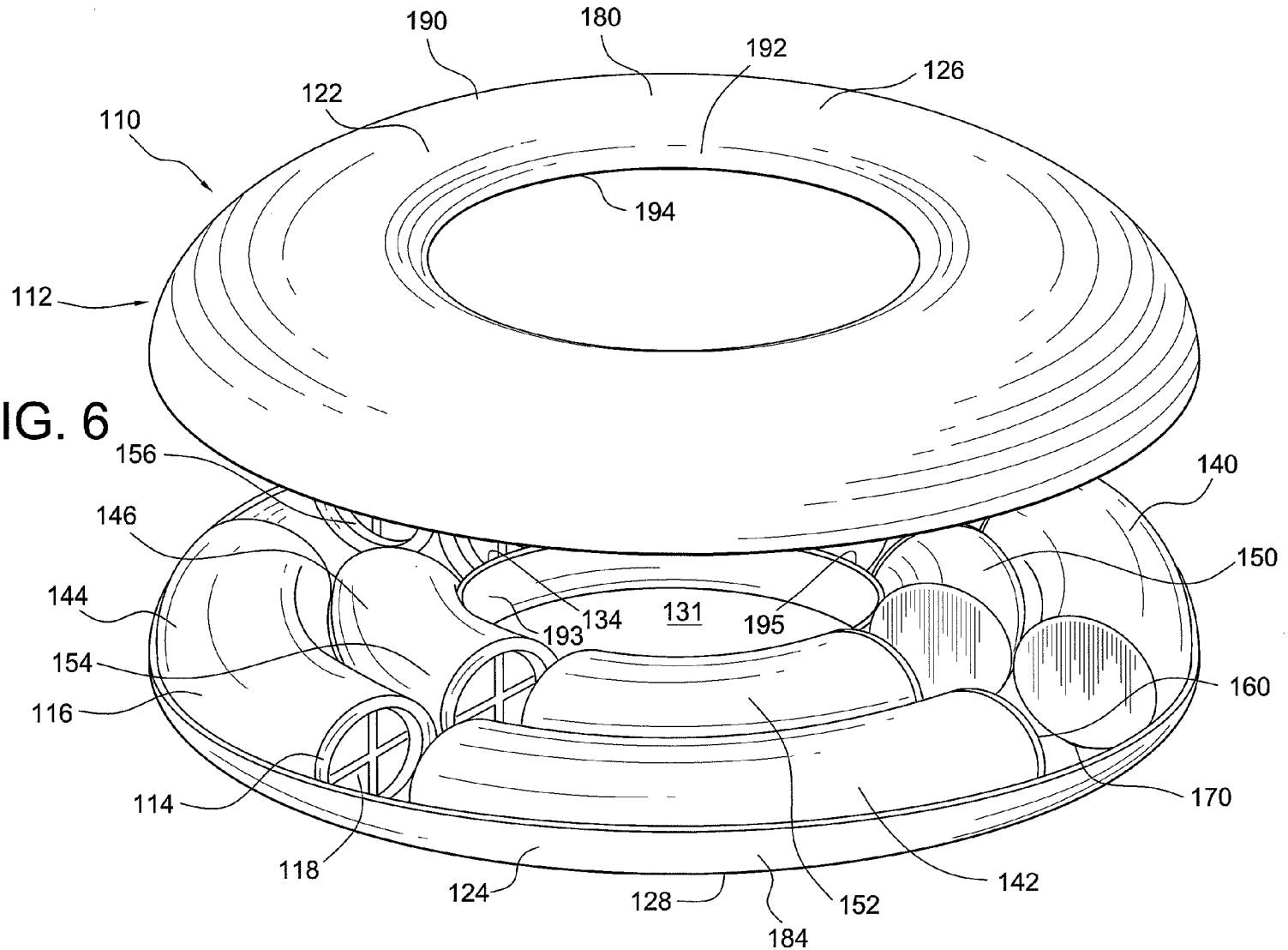
FIG. 6 is a further exploded perspective view of the loudspeaker shown with reference to FIG. 5.
Figure 8:
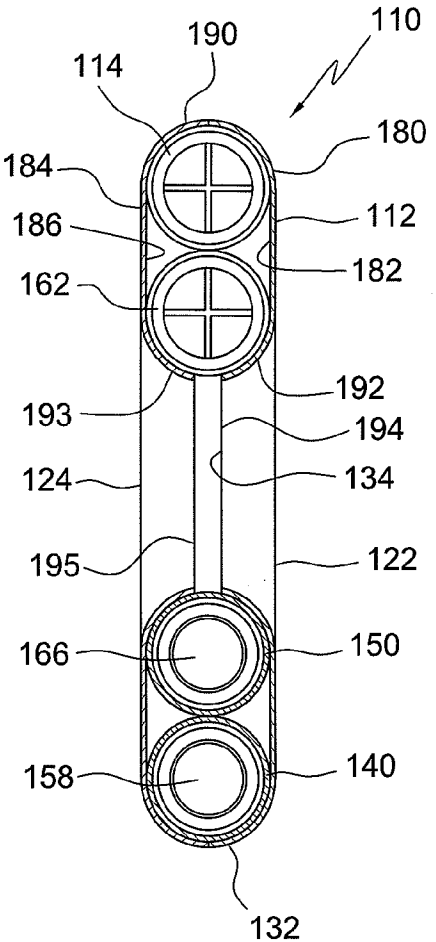
FIG. 8 is a cross sectional view along the line 8-8 in FIG. 7.
Figure 7:
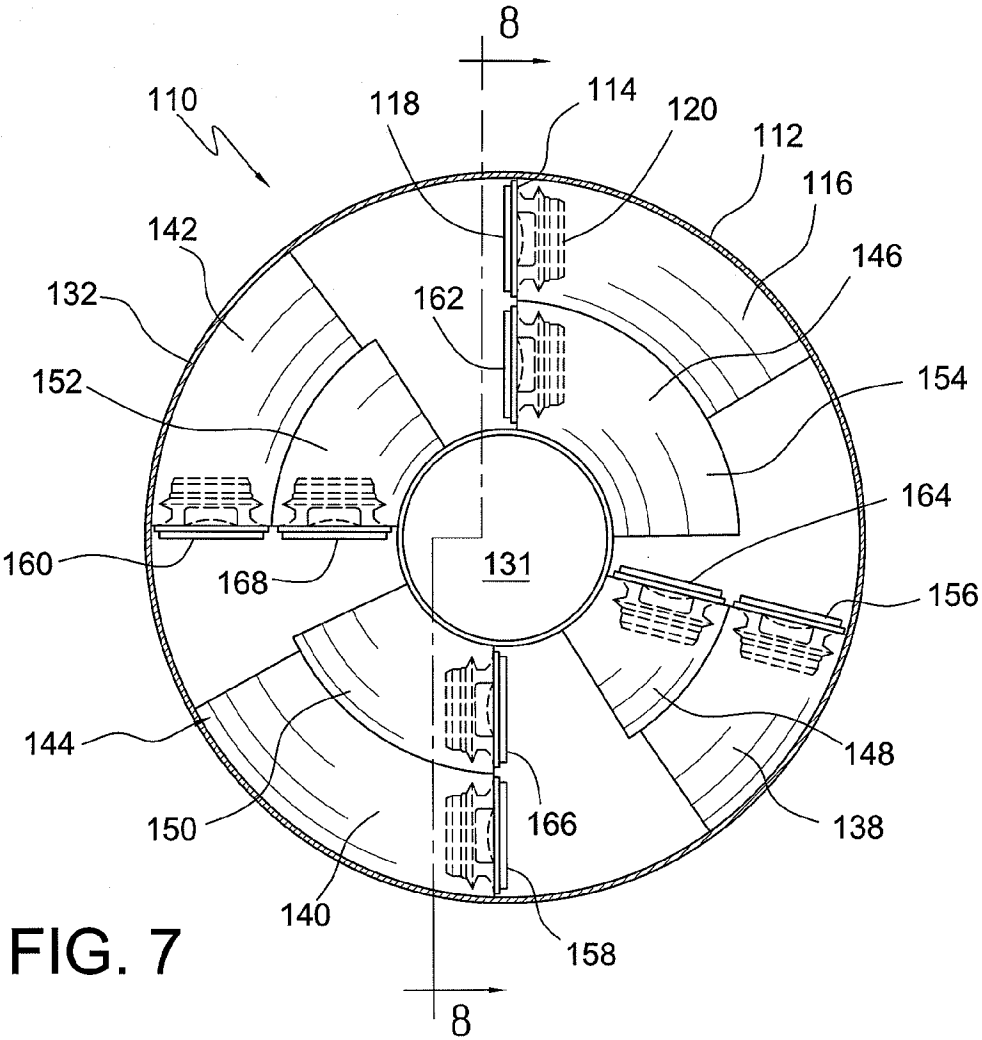
FIG. 7 is a top schematic view of the loudspeaker shown with reference to FIG. 5.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to the various figures, a low profile, substantially toroidal shaped low frequency loudspeaker 10 (that is, subwoofer) is disclosed. As used herein the term "toroidal" is intended to refer to a doughnut-shaped surface generated by a circle rotated about an axis in its plane that does not intersect the circle. The loudspeaker 10 includes a substantially toroidal shaped housing 12 with at least one driver 14, 56, 58, 60, 62, 64, 66, 68 positioned within the housing 12. The driver 14, 56, 58, 60, 62, 64, 66, 68 is mounted within an arcuate enclosure 16, 38, 40, 42, 46, 48, 50, 52 such that a forward portion 18 of the driver 14, 56, 58, 60, 62, 64, 66, 68 transmits sound beyond the arcuate enclosure 16, 38, 40, 42, 46, 48, 50, 52 and the rearward portion 20 of the driver 14, 56, 58, 60, 62, 64, 66, 68 is substantially confined within the arcuate enclosure 16, 38, 40, 42, 46, 48, 50, 52. The loudspeaker 10 is particularly adapted for use in aircraft where weight is often a critical consideration. With this in mind, it is contemplated the loudspeaker will weigh between approximately 2 lbs. to approximately 3 lbs. While the loudspeaker 10 is designed for use within an aircraft, those skilled in the art will appreciate it may be used in a variety of environments without departing from the spirit of the present invention.

By constructing the present loudspeaker in manner described below, an effective and efficient loudspeaker 10 is provided which is particularly adapted for positioning in limited spaces. In accordance with a preferred embodiment, the present loudspeaker will have approximately a 13-inch diameter and approximately a 2-inch thickness, although those skilled in the art will appreciate the specific configuration and components of the present loudspeaker may be varied in a manner that would allow for alteration of the specific size parameters of the loudspeaker. For example, it is contemplated the present loudspeaker is well suited for positioning within the side panel or under the seat of an aircraft.

In accordance with a preferred embodiment, the housing 12 includes upper and lower housing members 22, 24 secured together to form the complete housing 12 in accordance with the present invention. In accordance with a preferred embodiment, the upper housing member 22 is a split toroidal shape defining the upper surface 26 of the housing 12. As such, the upper housing member 22 is annular and includes a convex outer surface 80 and a concave inner surface 82. The lower housing member 24 is substantially disk shaped defining the lower surface 28 of the housing 12. The lower housing member 24 includes a concave inner surface 84 with a substantially flat central portion 86 and an outer, upstanding rim 88. The lower housing member also includes a convex outer surface 85. The outer, upstanding rim 88 is shaped and dimensioned to match the radius of the curvature of the convex outer surface 80 of the upper housing member 22 such that when the upper and lower housing members 22, 24 are assembled, the housing 12 includes a continuous exterior surface 90.

As mentioned above, the upper housing member 22 and the lower housing member 24 are assembled to create the housing 12 for the loudspeaker 10. The housing 12 includes an upper surface 26 and a lower surface 28. The upper and lower surfaces 26, 28 are connected by an inner wall 30 (with an annular opening 34, discussed below, positioned between the upper and lower surfaces 26, 28) and an outer wall 32. The inner wall 30 includes the internally oriented portion 92 of the convex outer surface 80 of the upper housing member 22. The inner wall 30 substantially defines a Venturi from which sound is emitted in a manner discussed below in greater detail. The outer wall 32 defines the outer circumference of the present loudspeaker 10. The exterior surface 90 of the housing 12 includes various rounded surfaces. Those skilled in the art will appreciate the specific shape of the surfaces may be varied to suite specific aesthetic needs.

As will be appreciated based upon the following disclosure, the inner wall 30 of the housing 12 includes an annular opening 34 for the transmission of sound from the drivers housed therein. More particularly, the annular opening 34 is formed within the inner wall 30 providing fluid communication with the various drivers housed within the housing 12. The annular opening 34 is specifically the space between the inner edge 94 of the upper housing member 22 and the flat central portion 86 of the lower housing member 24. As a result, the flat central portion 86 defines a directing wall which forces sound waves passing through the annular opening 34 in the direction of the upper housing member 22 in a manner optimizing the sound produced by the present loudspeaker 10. As those skilled in the art will further appreciate, the position, size and shape of the annular opening 34 is dictated by the position and construction of the drivers, and may, therefore, be varied without departing from the spirit of the present invention. In practice, the annular opening 34 is sized, shaped and positioned to provide for excursion of the driver cones and the transmission of sound from the enclosure, while still creating sufficient backpressure within the housing 12 for the proper functioning of the drivers.

The housing 12 is preferably constructed of liquid metal material in a series of multiple castings. However, those skilled in the art will appreciate various other materials may be used without departing from the spirit of the present invention.

In accordance with a preferred embodiment, a plurality of arcuate enclosures 16, 38, 40, 42, 46, 48, 50, 52 are positioned within the housing 12. The arcuate enclosures 16, 38, 40, 42, 46, 48, 50, 52 generally follow the curve of the housing 12. Each arcuate enclosure 16, 38, 40, 42, 46, 48, 50, 52 includes an open first end 16*a*, 38*a*, 40*a*, 42*a*, 46*a*, 48*a*, 50*a*, 52*a* in which a driver 14, 56, 58, 60, 62, 64, 66, 68 (which in accordance with a preferred embodiment are substantially the same) is mounted, cylindrical side walls 16*b*, 38*b*, 40*b*, 42*b*, 46*b*, 48*b*, 50*b*, 52*b* and a closed second end 16*c*, 18*c*, 40*c*, 42*c*, 46*c*, 48*c*, 50*c*, 52*c*. The aligned arcuate enclosures 16, 38, 40, 42, 46, 48, 50, 52 are positioned about the circumference of the housing 12 to define first and second rings 44, 54. Each of the enclosures is preferably constructed of liquid metal, although other materials may be used without departing from the spirit of the present invention.

More particularly, and in accordance with a preferred embodiment, the loudspeaker 10 includes first, second, third and fourth arcuate enclosures 16, 38, 40, 42 positioned within the housing 12 in a manner defining an inner first ring 44 of the arcuate enclosures 16, 38, 40, 42. The loudspeaker 10 further includes fifth, sixth, seventh and eighth arcuate enclosures 46, 48, 50, 52 positioned within the housing 12 in a manner defining an outer second ring 54. The arcuate enclosures 16, 38, 40, 42, 46, 48, 50, 52 are of various lengths dictated by the desired sound generated by the driver contained therein. It is contemplated, the aligned enclosures may taper at their respective closed ends, that is, the end opposite the driver, in a symmetrical or irregular fashion to enhance the Venturi effect or to allow the accommodation of additional drivers. An additional result of the present loudspeaker 10 is the propagation of multiple fundamental resonances produced by the differing lengths and volumes of the arcuate enclosures 16, 38, 40, 42, 46, 48, 50, 52, allowing for optimum utilization of the selected drivers 14, 56, 58, 60, 62, 64, 66, 68 (so as to not necessarily produce a "flat" frequency response).

Respectively provided with the first, second, third, fourth, fifth, sixth, seventh and eighth arcuate enclosures 16, 38, 40, 42, 46, 48, 50, 52 are first, second, third, fourth, fifth, sixth, seventh and eighth drivers 14, 56, 58, 60, 62, 64, 66, 68. Each of the drivers 14, 56, 58, 60, 62, 64, 66, 68 is mounted within the respective arcuate enclosures 16, 38, 40, 42, 46, 48, 50, 52 such that a forward portion 18 of the driver 14, 56, 58, 60, 62, 64, 66, 68 transmits sound beyond the arcuate enclosure 16, 38, 40, 42, 46, 48, 50, 52 and the rearward portion 20 of the driver 14, 56, 58, 60, 62, 64, 66, 68 is substantially confined within the arcuate enclosure 16, 38, 40, 42, 46, 48, 50, 52.

By orienting the drivers in this manner, a plurality of drivers may be positioned within a limited space to efficiently and effectively provide low frequency sound where space is at a premium and conventional subwoofers are not appropriate. The use of multiple drivers within the same loudspeaker results in the provision of a loudspeaker with a relatively large cumulative magnet mass within a limited housing profile. It is important to note that the larger relative surface area of the collective magnet mass of the drivers allows for much better dissipation of heat than would be the case in a conventional speaker design, providing the benefit of better power-handling in a compact design.

In addition, the alignment of the drivers 14, 56, 58, 60, 62, 64, 66, 68 in this manner creates airflow within the housing 12 that acts to cool adjacent drivers 14, 56, 58, 60, 62, 64, 66, 68 as the air moved during actuation thereof is passed within the housing 12. This airflow acts to cool all of the drivers 14, 56, 58, 60, 62, 64, 66, 68 within the housing 12 as the drivers 14, 56, 58, 60, 62, 64, 66, 68 and arcuate enclosures 16, 38, 40, 42, 46, 48, 50, 52 are not sealingly engaged with the housing 12 and air may, therefore, flow around and over the drivers 14, 56, 58, 60, 62, 64, 66, 68 and arcuate enclosures 16, 38, 40, 42, 46, 48, 50, 52 positioned within the housing 12.

In accordance with a preferred embodiment, the lengths of the arcuate enclosures 16, 38, 40, 42, 46, 48, 50, 52 are varied. By varying the length of the arcuate enclosures 16, 38, 40, 42, 46, 48, 50, 52, one is able to alter the frequency response of each of the drivers 14, 56, 58, 60, 62, 64, 66, 68 so as to achieve a relatively flat frequency response for the entire loudspeaker 10.

Secure positioning of the arcuate enclosures 16, 38, 40, 42, 46, 48, 50, 52 and drivers 14, 56, 58, 60, 62, 64, 66, 68 within the housing 12 is achieved by placing foam 70 between the housing 12 and enclosures/drivers. This prevents undesirable movement between the enclosures/drivers and the housing 12, while simultaneously permitting the flow of air throughout the housing 12.

Although foam is disclosed in accordance with a preferred embodiment, it is contemplated the foam may be removed and the enclosures may be mechanically interfit within the housing through the utilization of mechanical joints. It is believed such a construction may provide for an altered output appropriate for various applications.

In accordance with an alternate embodiment, the inner wall 130 of the housing 112 may define a central opening 131 that passes completely through the loudspeaker 110. It is contemplated such a design would be appropriate for use when the loudspeaker 110 is mounted in an open space. More particularly, and with reference to the various figures, a low profile, toroidal shaped low frequency loudspeaker 110 (that is, subwoofer) is disclosed. The loudspeaker 110 includes a toroidal shaped housing 112 with at least one driver 114, 156, 158, 160, 162, 164, 166, 168 positioned within the housing 112. The driver 114, 156, 158, 160, 162, 164, 166, 168 is mounted within an arcuate enclosure 116, 138, 140, 142, 146, 148, 150, 152 such that a forward portion 118 of the driver 114, 156, 158, 160, 162, 164, 166, 168 transmits sound beyond the arcuate enclosure 116, 138, 140, 142, 146, 148, 150, 152 and the rearward portion 120 of the driver 114, 156, 158, 160, 162, 164, 166, 168 is substantially confined within the arcuate enclosure 116, 138, 140, 142, 146, 148, 150, 152.

In accordance with a preferred embodiment, the housing 112 includes upper and lower housing members 122, 124 secured together to form the complete housing 112 in accordance with the present invention. In accordance with a preferred embodiment, both the upper housing member 122 and the lower housing member 124 are of a split toroidal shape and respectively define the upper and lower surface 126, 128 of the housing 112. As such, both the upper housing member 122 and the lower housing member 124 are annular and respectively include a convex outer surface 180, 184 and a concave inner surface 182, 186. The convex outer surfaces 180, 184 of the upper housing member 122 and the lower housing member 124 have matching radii of curvature such that when the upper and lower housing members 122, 124 are assembled, the housing 112 includes a continuous outer surface 190.

As mentioned above, the upper housing member 122 and the lower housing member 124 are assembled to create the housing 112 for the loudspeaker 110. The housing 112 includes an upper surface 126 and a lower surface 128. The upper and lower surfaces 126, 128 are connected by an inner wall 130 (with an annular opening 134, discussed below, positioned between the upper and lower surfaces 126, 128) and an outer wall 132. The inner wall 130 includes the internally oriented portions 192, 193 of the convex outer surfaces 180, 184 of the upper housing member 122 and the lower housing member 124 to define an opening 131 that passes fully through center of the loudspeaker 110. The inner wall 130 substantially defines a Venturi from which sound is emitted in a manner discussed below in greater detail.

The outer wall 132 of the housing 112 defines the outer circumference of the present loudspeaker 110. The exterior surface of the housing 112 includes various rounded surfaces. Those skilled in the art will appreciate the specific shape of the surfaces may be varied to suite specific aesthetic needs.

As will be appreciated based upon the following disclosure, the inner wall 130 of the housing 112 includes an annular opening 134 for the transmission of sound from the drivers housed therein. More particularly, the annular opening 134 is formed within the inner wall 130 providing fluid communication with the various drivers housed within the housing 112. The annular opening 134 is specifically the space between the inner edges 194, 195 of the upper housing member 122 and the lower housing member 124. As those skilled in the art will further appreciate, the position, size and shape of the annular opening 134 is dictated by the position and construction of the drivers, and may, therefore, be varied without departing from the spirit of the present invention. In practice, the annular opening 134 is sized, shaped and positioned to provide for excursion of the driver cones and the transmission of sound from the enclosure, while still creating sufficient backpressure within the housing 112 for the proper functioning of the drivers.

In accordance with a preferred embodiment, a plurality of arcuate enclosures 116, 138, 140, 142, 146, 148, 150, 152 are positioned within the housing 112. The arcuate enclosures 116, 138, 140, 142, 146, 148, 150, 152 generally follow the curve of the housing 112. As discussed above, each enclosure includes an open first end, a cylindrical sidewall and a closed second end. The aligned arcuate enclosures 116, 138, 140, 142, 146, 148, 150, 152 are positioned about the circumference of the housing 112 to define first and second rings 144, 154.

More particularly, and in accordance with a preferred embodiment, the loudspeaker 110 includes first, second, third and fourth arcuate enclosures 116, 138, 140, 142 positioned within the housing 112 in a manner defining an inner first ring 144 of the arcuate enclosures 116, 138, 140, 142. The loudspeaker 110 further includes fifth, sixth, seventh and eighth arcuate enclosures 146, 148, 150, 152 positioned within the housing 112 in a manner defining an outer second ring 154. The arcuate enclosures 116, 138, 140, 142, 146, 148, 150, 152 are of various lengths dictated by the desired sound generated by the driver contained therein. As mentioned above, an additional result of the present loudspeaker 110 is the propagation of multiple fundamental resonances produced by the differing lengths and volumes of the arcuate enclosures 116, 138, 140, 142, 146, 148, 150, 155, allowing for optimum utilization of the selected drivers 114, 156, 158, 160, 162, 164, 166, 168 (so as to not necessarily produce a "flat" frequency response).

Respectively provided with the first, second, third, fourth, fifth, sixth, seventh and eighth arcuate enclosures 116, 138, 140, 142, 146, 148, 150, 152 are first, second, third, fourth, fifth, sixth, seventh and eighth drivers 114, 156, 158, 160, 162, 164, 166, 168 (which in accordance with a preferred embodiment are substantially the same). Each of the drivers 114, 156, 158, 160, 162, 164, 166, 168 is mounted within the respective arcuate enclosures 116, 138, 140, 142, 146, 148, 150, 152 such that a forward portion 118 of the driver 114, 156, 158, 160, 162, 164, 166, 168 transmits sound beyond the arcuate enclosure 116, 138, 140, 142, 146, 148, 150, 152 and the rearward portion 120 of the driver 114, 156, 158, 160, 162, 164, 166, 168 is substantially confined within the arcuate enclosure 116, 138, 140, 142, 146, 148, 150, 152.

In addition, the alignment of the drivers 114, 156, 158, 160, 162, 164, 166, 168 in this manner creates airflow within the housing 112 that acts to cool adjacent drivers 114, 156, 158, 160, 162, 164, 166, 168 as the air moved during actuation thereof is passed within the housing 112. This airflow acts to cool all of the drivers 114, 156, 158, 160, 162, 164, 166, 168 within the housing 112 as the drivers 114, 156, 158, 160, 162, 164, 166, 168 and arcuate enclosures 116, 138, 140, 142, 146, 148, 150, 152 are not sealingly engaged with the housing 112 and air may, therefore, flow around and over the drivers 114, 156, 158, 160, 162, 164, 166, 168 and arcuate enclosures 116, 138, 140, 142, 146, 148, 150, 152 positioned within the housing 112.

In accordance with a preferred embodiment, the length of the arcuate enclosures 116, 138, 140, 142, 146, 148, 150, 152 is varied. By varying the length of the arcuate enclosures 116, 138, 140, 142, 146, 148, 150, 152, one is able to alter the frequency response of each of the drivers 114, 156, 158, 160, 162, 164, 166, 168 so as to achieve a relatively flat (see above) frequency response for the entire loudspeaker 110.

Secure positioning of the arcuate enclosures 116, 138, 140, 142, 146, 148, 150, 152 and drivers 114, 156, 158, 160, 162, 164, 166, 168 within the housing 112 is achieved by placing foam 170 between the housing 112 and enclosures/drivers. This prevents undesirable movement between the enclosures/drivers and the housing 112, while simultaneously permitting the flow of air throughout the housing 112.

The concepts underlying the present loudspeaker allow for the handling of a relative large power capacity within the relatively small space, while simultaneously providing for substantial heat dissipation without the need for ambient active cooling. This is highly important when one considers the proportionate size magnets and voice coils of the drivers used in accordance with the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A loudspeaker, comprising:

a toroidal shaped housing composed of an upper housing member and a lower housing member;

a plurality of drivers positioned within the housing, each of the drivers being housed in an arcuate enclosure positioned within the housing, wherein each of the arcuate enclosures includes a first end, a cylindrical sidewall and a second end the arcuate enclosures are positioned about a circumference of the housing to define a first ring and the arcuate enclosures have varying lengths allowing for alteration of a frequency response of the plurality of drivers, each of the drivers being mounted within the first end of respective arcuate enclosures such that a forward portion of the driver transmits sound beyond the arcuate enclosure and a rearward portion of the driver is substantially confined within the arcuate enclosure.

2. The loudspeaker according to claim 1, wherein the upper housing member is a split toroidal shape defining an upper surface of the housing and the lower housing member is substantially disk shaped defining a lower surface of the housing.

3. The loudspeaker according to claim 2, wherein the housing includes an outer wall defining an outer circumference of the loudspeaker and an inner wall, and the inner wall includes an annular opening positioned between the upper surface and lower surfaces.

4. The loudspeaker according to claim 3, wherein the annular opening is defined by an inner edge of the upper housing member and a central flat portion of the lower housing member.

5. The loudspeaker according to claim 3, wherein the annular opening is formed along an inner wall of the housing positioned between the upper surface and the lower surface.

6. The loudspeaker according to claim 5, wherein the inner wall of the housing defines a central opening that passes completely through the loudspeaker.

7. The loudspeaker according to claim 5, wherein the inner wall substantially defines a Venturi from which sound is emitted.

8. The loudspeaker according to claim 1, wherein the housing is constructed of liquid metal material.

9. The loudspeaker according to claim 1, wherein the arcuate enclosures are positioned about the circumference of the housing to define the first ring and a second ring.

10. The loudspeaker according to claim 9, wherein first, second, third and fourth arcuate enclosures are positioned within the housing in a manner defining the first ring and fifth, sixth, seventh and eighth arcuate enclosures are positioned within the housing in a manner defining the second ring.

11. The loudspeaker according to claim 1, wherein first, second, third and fourth arcuate enclosures are positioned within the housing in a manner defining the first ring and the lengths of the first, second, third and fourth arcuate enclosures are varied.

12. The loudspeaker according to claim 1, wherein loudspeaker is subwoofer.

* * * * *